US005299405A

United States Patent [19]

Thompson

[11] Patent Number: 5,299,405

[45] Date of Patent: Apr. 5, 1994

[54] WALL ASSEMBLY

[75] Inventor: James E. Thompson, Garland, Tex.

[73] Assignee: Trinity Industries, Inc., Dallas, Tex.

[21] Appl. No.: 926,238

[22] Filed: Aug. 6, 1992

[51] Int. Cl.[5] ..... E04C 2/32

[52] U.S. Cl. ..... 52/795; 29/455.1; 52/630; 52/453; 52/745.05

[58] Field of Search ..... 52/795–801, 52/671, 674, 336, 630, 795, 745.05; 29/455.1; 14/69.5; 428/593

[56] References Cited

U.S. PATENT DOCUMENTS

| | | | |
|---|---|---|---|
| 1,000,758 | 8/1911 | Rude | 52/630 |
| 1,324,982 | 12/1919 | Rogers | 29/455.1 |
| 1,867,433 | 7/1932 | Young | 52/801 |
| 2,019,707 | 11/1935 | Jenkins | 52/630 |
| 2,688,761 | 9/1954 | Good, Jr. et al. | 14/71 |
| 3,029,910 | 4/1962 | Kirk et al. | 428/593 |
| 3,060,471 | 10/1962 | Der Yuen et al. | 14/71 |
| 3,110,048 | 11/1963 | Bolton | 14/71 |
| 3,123,167 | 3/1964 | Lichti | 180/6.5 |
| 3,184,772 | 5/1965 | Moore et al. | 14/71 |
| 3,263,253 | 8/1966 | Wollard et al. | 14/71 |
| 3,263,254 | 8/1966 | Wollard et al. | 14/71 |
| 3,315,291 | 4/1967 | Wollard et al. | 14/71 |
| 3,377,638 | 4/1968 | Seipos | 14/71 |
| 3,462,784 | 8/1969 | Seipos | 14/71 |
| 4,042,992 | 8/1977 | Hyslop | 14/69.5 |

FOREIGN PATENT DOCUMENTS

| | | | |
|---|---|---|---|
| 275709 | 9/1951 | Switzerland | 52/795 |

*Primary Examiner*—James L. Ridgill, Jr.
*Attorney, Agent, or Firm*—Baker & Botts

[57] ABSTRACT

A wall assembly used in the construction of passenger boarding bridges or other box type structures. The wall assembly includes an exterior panel with V-shaped folds or corrugations and a vertical flange on the end of each panel for attachment to adjacent panels.

19 Claims, 2 Drawing Sheets

WALL ASSEMBLY

TECHNICAL FIELD OF THE INVENTION

This invention relates to a wall assembly used in the construction of passenger boarding bridges or other box-type structures. More particularly, the present invention relates to a wall assembly having an exterior panel which provides improved insulation, greater mechanical strength, and reduced manufacturing costs.

BACKGROUND OF THE INVENTION

Passenger boarding bridges such as those used at airports and on cruise ship docks have traditionally been constructed from sheet metal with corrugated panels on their exterior for strength and support. These exterior panels are welded together to make the wall, floor and roof portions of the boarding bridge. The conventional panel design has a generally symmetrical cross-section with the corrugations running normal to the longitudinal axis of the boarding bridge. Conventional panels slightly overlap each other creating a vertical seam which is continuously welded along with the top and bottom of each panel.

The conventional exterior panel design results in a substantial portion of the wall assembly having no insulation and requires a sixty inches wide strip of sheet metal to produce a finished panel forty eight inches wide. Therefore, it is highly desirable to construct a wall assembly with a greater insulation R value, more economical use of raw material, reduced welding requirements and lighter in weight with more interior design flexibility.

SUMMARY OF THE INVENTION

In accordance with the present invention, a wall assembly with an exterior panel is provided which substantially eliminates or reduces disadvantages and problems associated with prior wall assembly designs.

One object of the present invention is to provide an exterior panel which requires substantially less welding to assemble the walls of a passenger boarding bridge, provide better use of raw material and allow for more effective use of insulation within the completed wall assembly.

Another object of the present invention is to provide a multiple layer wall assembly which is lighter in weight than previous wall assemblies and has reduced outside dimensions as compared to prior assemblies.

Additional objects and advantages of the present invention will be apparent to those skilled in the art from studying the following detailed description in conjunction with the accompanying drawings and claims.

BRIEF DESCRIPTION OF THE DRAWINGS

For a better understanding of the present invention, reference may be made to the accompanying drawings in which.

DETAILED DESCRIPTION OF THE INVENTION

Figure 1:
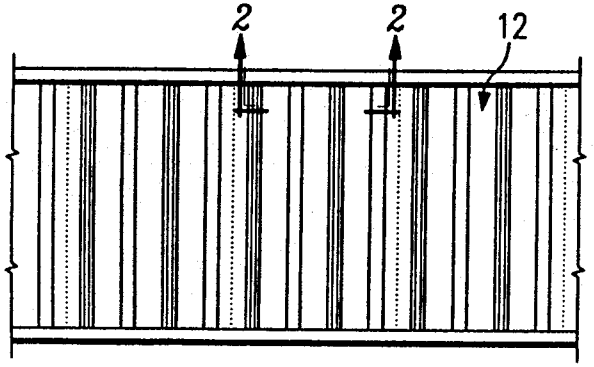
FIG. 1 (PRIOR ART)
FIG. 1 is a schematic view in elevation with portions broken away of a typical wall assembly which has been previously used in the construction of passenger boarding bridges.
Figure 2:
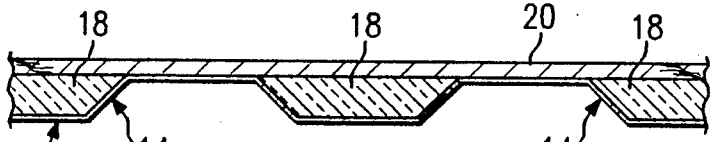
FIG. 2 (PRIOR ART)
FIG. 2 is a drawing in section with portions broken away taken along line 2—2 of FIG. 1.
Figure 3:
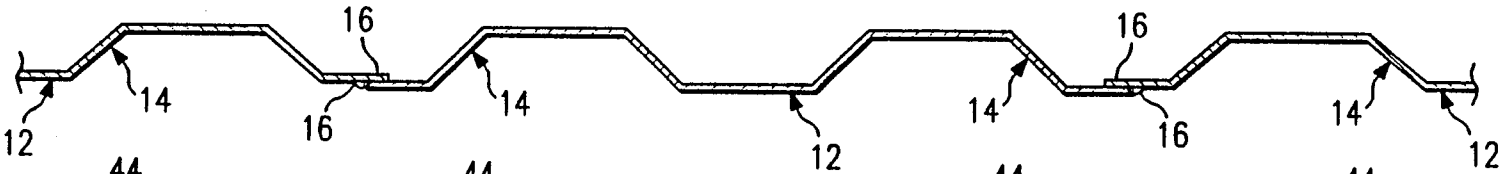
FIG. 3 (PRIOR ART)
FIG. 3 is a drawing is section with portions broken away showing only the exterior panels used with the wall assembly of FIG. 1.
Figure 8:
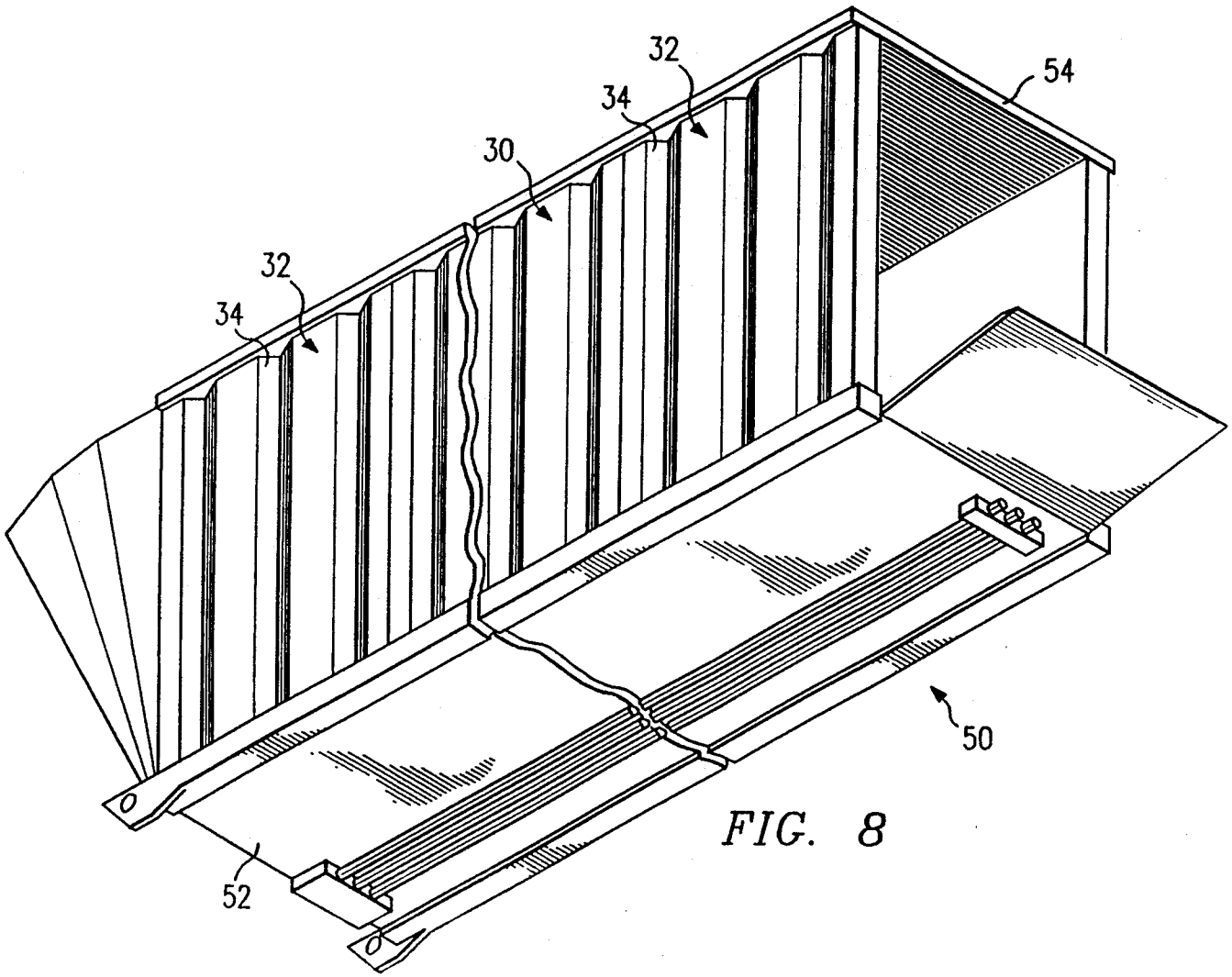
FIG. 8 is an isometric drawing of a passenger boarding bridge constructed with wall assemblies shown in FIGS. 4–7.

Wall assembly 10 which has previously been used in the construction of passenger boarding bridges is shown in FIGS. 1 and 2. The main strength member of wall assembly 10 is exterior panel 12. Typically, exterior panel 12 is formed from fourteen gauge sheet steel with regularly spaced corrugation 14 as shown in FIGS. 2 and 3. Corrugations 14 result in exterior panel 12 having a generally symmetrical cross-section. Each end 16 of exterior panel 12 which run parallel with corrugations 14 is continuously welded to an adjacent exterior panel 12 for use in constructing wall assembly 10. The top and bottom of panel 12 may also be welded to adjacent panels to form a box-type enclosure such as traditionally found in passenger boarding bridges. These bridges are also sometimes referred to as "tunnels". An example of a passenger boarding bridge is shown in FIG. 8. As best shown in FIGS. 2 and 3, corrugations 14 in exterior panel 12 have the general cross-section of a trapezoid.

Insulating material 18 is disposed in the corrugations 14 which will be covered by interior panel 20. As best shown in FIG. 2, the design of exterior panel 12 results in substantial portions of wall assembly 10 not being protected with insulation. Interior panel 20 may be wall board or any other desired covering.

Figure 4:
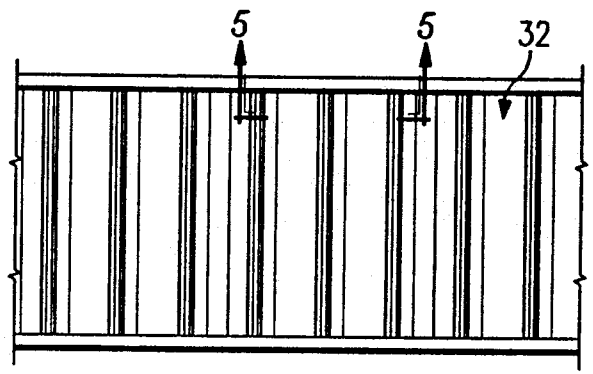
FIG. 4 is a drawing in elevation with portions broken away showing the wall assembly of the present invention.
Figure 5:
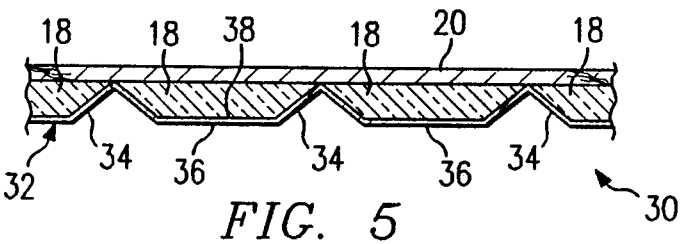
FIG. 5 is a drawing in section with portions broken away taken along lines 5—5 of FIG. 4.

Wall assembly 30 of the present invention as shown in FIGS. 4 and 5 incorporates a unique exterior panel 32 which results in substantially improved performance characteristics of wall assembly 30 as compared to conventional wall assembly 10. These advantages result from having a plurality of V-shaped corrugations or folds 34 as compared to trapezoid corrugations 14 of exterior panel 12. Flat portions 36 are provided between each corrugation 34. The same interior panel 20 may be used with wall assembly 30 as used as used with wall assembly 10. As will be explained later, the use of exterior panel 32 allows for much greater design flexibility in selecting interior panel 20.

Figure 6:
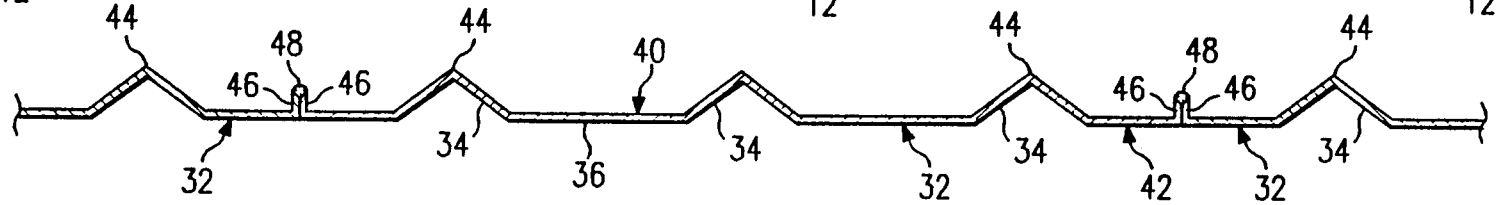
FIG. 6 is a drawing in section with portions broken away showing only the exterior panel used with the wall assembly in FIG. 4.

The cross-section of exterior panel 32 is not symmetrical as shown in FIGS. 5 and 6. The asymmetrical cross-section results in wall assembly 30 having a substantially increased capacity in void spaces 38 for the installation of insulating material 18. As can be seen by comparing FIGS. 2 and 5, the present invention results in wall assembly 30 being protected by a substantially larger amount of insulation as compared to wall assembly 10. V-shaped corrugations 34 of exterior panel 32 allow designers of passenger boarding bridge 50 as shown in FIG. 8 to reduce the overall wall thickness of wall assembly 30 and increase the overall insulation (R value) as compared to wall assembly 10.

V-shaped corrugations 34 improve the ability of exterior panel 32 to resist buckling (compression loads) as compared to exterior panel 12 with trapezoid corrugations 14. Since exterior panel 32 is more rigid and less prone to buckling than exterior panel 12, lighter gauge sheet steel may be used in the manufacture of wall assembly 30. V-shaped corrugations 34 allow designing exterior panel 32 for optimum overall thickness of the finished wall assembly and to maximize the use of the raw sheet steel. V-shaped corrugations 34 provide additional opportunities to reduce the cost and/or weight of wall assembly 30.

Figure 7:
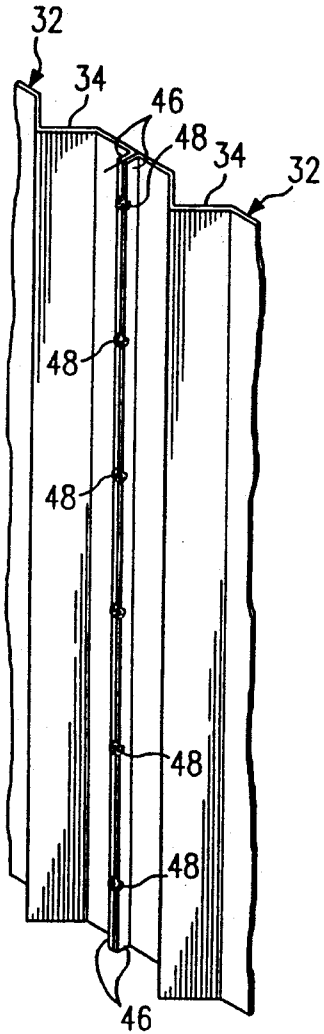
FIG. 7 is a drawing in elevation with portions broken away showing the attachment of adjacent panels in FIG. 6.

The use of V-shaped corrugations 34 results in exterior panel 32 having nonsymmetrical inner surface 40 and exterior surface 42. These surfaces have a different visual appearance. Vertex 44 of V corrugations 34 project inwardly. Also, the ends of exterior panel 32 are turned inwardly to form flanges 46 for abutment with adjacent panels 32. Flanges 46 project inwardly in the same direction as V-shaped corrugations 34. As best shown in FIGS. 6 and 7, flanges 46 of adjacent exterior panels 32 cooperate with each other to provide means for fastening or attaching the adjacent panels of wall assembly 30. Since flanges 46 may be placed in close contact, spot welds 48 can be used to mechanically attach adjacent panels 32. The use of flanges 46 and spot welds 48 reduces the need for continuous welding of the vertical seam between panels 2. However, continuous welding may be used if required for specific wall assembly designs. Other fasteners, such as clamps, bolts, screws or adhesives may be used with flanges 46 to mechanically attach adjacent panels 32 instead of welding.

By using V-shaped corrugations 34 and flanges 46, a strip of raw sheet metal sixty inches wide will produce a panel which is fifty-four inches wide with no waste. Corrugations 14 as used with exterior panel 12 will result in a finished product of only forty-eight inches in width when starting with raw sheet metal sixty inches wide. Since the effective length of exterior panel 32 is substantially increased as compared to the effective width of exterior panel 12, the length of continuous welding required at the top and bottom of wall assembly 30 has been reduced by approximately 6.5 percent as compared to wall assembly 10. This same increase in effective width of exterior panel 32, when starting with same sixty inches wide strip of raw sheet metal, results in a lighter weight structure for the same overall length of passenger boarding bridge. Also, V-shaped corrugations 34 allow the use of sixteen gauge as compared to fourteen gauge sheet steel.

FIG. 8 shows passenger boarding bridge 50 which incorporates wall assembly 30. Floor assembly 52 and ceiling assembly 54 are shown as uniform, flat surfaces. The use of exterior panel 32 results in passenger boarding bridge 50 having either reduced outside dimensions and the same interior as a passenger boarding bridge constructed with exterior panel 12 or passenger boarding bridge 50 could have the same overall outside dimensions and a substantially increased or modified interior panel 20. V-shaped corrugations 34 provide greater flexibility for alternative interior wall coverings and more clearance if passenger transfer bridge 50 is part of a telescoping, multiple section structure. Wall assembly 10 with exterior panel 12 and interior panel 20 will typically have a thickness of three (3) inches. Exterior panel 32 allows the thickness of wall assembly 30 to be reduced to two and one-half (2½) inches for the same interior panel 20.

Alternative Embodiments

The present invention has been described with respect to wall assembly 30 and passenger boarding bridge 50. Those skilled in the art will readily note that exterior panel 32 could be readily used in the manufacture of ceiling or floor assemblies.

Wall assembly 30 is not limited to use in passenger boarding bridges. Those skilled in the art will readily note that wall assembly 30 could be used in various box type tunnel structures. Such structures include, but are not limited to, walkways between buildings and within buildings.

Depending upon the operating environment of passenger boarding bridge 50, insulating material 18 may not be required in wall assembly 30. For wall assemblies which do not require insulation, there may be advantages to placing the interior panel adjacent to flat portions 36 and having vertex 44 of V-shaped corrugations 34 projecting outwardly from the wall assembly.

Although the present invention has been described in detail, it should be understood that various changes, substitutions, and alterations can be made thereto without departing from the spirit and scope of the present invention as defined by the following claims.

What is claimed is:

1. A method for constructing a passenger boarding bridge with a plurality of wall assemblies comprising:
   - forming from one sheet of material an exterior panel for each wall assembly with V-shaped corrugations, each corrugation having a pointed vertex and an open end, each of the open ends connected by a flat portion of the panel;
   - permanently attaching exterior panels of adjacent wall assemblies to each other; and
   - placing an interior panel next to the exterior panel of each wall assembly.

2. The method of construction in claim 1 including the steps of:
   - attaching adjacent exterior panels to each other with the vertex of the V-shaped corrugations projecting towards the interior of the passenger boarding bridge; and
   - placing insulating material on the inner surface of the exterior panel between the vertex of each V-shaped corrugation with the insulating material disposed between the exterior panel and the interior panel.

3. The method of construction in claim 1 including the step of forming a flange on the end of each exterior panel parallel with and projecting in the same direction as the V-shaped corrugations.

4. The method of construction in claim 3 including the step of fastening the flanges of adjacent panels to each other to form the wall assembly.

5. The method of construction in claim 3 including the step of continuously welding the top and bottom of the exterior panels to the passenger boarding bridge.

6. The method of construction in claim 3 including the step of forming the V-shaped corrugations and the flanges to project inwardly towards the interior panel.

7. A corrugated panel for use in constructing a wall assembly comprising:
   - a plurality of V-shaped folds in the panel with each fold having a pointed vertex and a flat portion in between each fold;

each end of the panel having a flange portion parallel with the V-shaped folds; and each V-shaped fold comprising structural support means for the wall assembly.

8. The corrugated panel, as set forth in claim 7, wherein the V-shaped fold further comprises a vertex which projects towards the interior of the wall assembly.

9. The corrugated panel, as set forth in claim 7, wherein the V-shaped fold further comprises a vertex which projects towards the exterior of the wall assembly.

10. The corrugated panel, as set forth in claim 7, wherein the flange portion projects from the panel in the same direction as the V-shaped fold.

11. The corrugated panel, as set forth in claim 10, wherein the vertex of the V-shaped fold and the flat portion cooperate to comprise a void space for installing insulating material in the wall assembly.

12. A method for constructing a passenger boarding bridge with a plurality of wall assemblies comprising:

forming each wall assembly from an exterior panel with V-shaped corrugations, each corrugation having a vertex;

attaching the exterior panels of adjacent wall assemblies to each other with the vertex of the V-shaped corrugations projecting towards the interior of the passenger boarding bridge;

placing insulating material on the inner surface of the exterior panel between the vertex of each V-shaped corrugation; and abutting an interior panel against the vertex of each corrugation of the associated exterior panel, with the insulating material disposed therebetween.

13. The method of construction in claim 12 including the step of forming a flange on the end of each exterior panel parallel with and projecting in the same direction as the V-shaped corrugations.

14. The method of construction in claim 13 including the step of fastening the flanges of adjacent panels to each other to form the wall assembly.

15. The method of construction in claim 13 including the step of continuously welding the top and bottom of the exterior panels to the passenger boarding bridge.

16. A wall assembly for use in manufacturing a tunnel type structure comprising:

an exterior panel having a plurality of V-shaped folds projecting inwardly towards the interior of the tunnel structure, each of the folds having a vertex;

each V-shaped fold comprising structural support means for the wall assembly;

the end of each exterior panel having means for attaching adjacent panels to each other;

an interior panel placed next to the exterior panel and abutting the vertex of each of the folds; and insulating means disposed between the interior panel and the exterior panel in a space defined in part by the V-shaped folds.

17. The wall assembly, as set forth in claim 16, wherein the means for attaching adjacent panels further comprises flange portions parallel with and projecting from each panel int he same direction as the V-shaped folds.

18. The wall assembly, as defined in claim 17, further comprising multiple spot welds attaching the flange portions to each other.

19. The wall assembly, as defined in claim 17, further comprising a continuous welded seam at the top and bottom of the exterior panels.

* * * * *